US009828159B1

(12) United States Patent
Messacar et al.

(10) Patent No.: US 9,828,159 B1
(45) Date of Patent: Nov. 28, 2017

(54) STORAGE AND DISPENSING SYSTEM FOR A FLEXIBLE BAG HAVING A FLOWABLE MATERIAL THEREIN

(71) Applicant: Scholle IPN Corporation, Northlake, IL (US)

(72) Inventors: Peter Messacar, Elmhurst, IL (US); Ryan Balock, Westchester, IL (US); Charles Thurman, Northlake, IL (US)

(73) Assignee: Scholle IPN Corporation, Northlake, IL (US)

( * ) Notice: Subject to any disclaimer, the term of this patent is extended or adjusted under 35 U.S.C. 154(b) by 0 days.

(21) Appl. No.: 15/242,658

(22) Filed: Aug. 22, 2016

(51) Int. Cl.
*B65D 35/56* (2006.01)
*B65D 77/06* (2006.01)
*B65D 47/24* (2006.01)

(52) U.S. Cl.
CPC ..... *B65D 77/06* (2013.01); *B65D 47/247* (2013.01)

(58) Field of Classification Search
CPC ..... B67D 3/00–3/04; B67D 3/0067; B65D 77/06; B65D 47/47
See application file for complete search history.

(56) References Cited

U.S. PATENT DOCUMENTS 268,313 A * 11/1882 Stokes ..... B65D 77/065 217/3 BC
3,325,058 A * 6/1967 West, Jr. ..... A47J 31/50 219/433
3,343,719 A * 9/1967 Kastamo ..... B65D 75/5833 222/1
3,453,033 A * 7/1969 Goss ..... B67D 3/00 220/495.05
4,143,795 A * 3/1979 Casebier ..... B67D 3/00 211/126.3
5,462,168 A * 10/1995 Oberhelman ..... A45C 11/20 206/427
6,334,329 B1 * 1/2002 Weller ..... F25D 3/08 62/371

(Continued)

FOREIGN PATENT DOCUMENTS

GB 2179526 A * 3/1987 ..... B65D 77/06
GB 2188305 A * 9/1987 ..... B65D 77/06

*Primary Examiner* — Nicholas J Weiss
*Assistant Examiner* — Randall Gruby
(74) *Attorney, Agent, or Firm* — The Watson I.P. Group, PLC; Jovan N. Jovanovic; Vladan M. Vasiljevic

(57) ABSTRACT

A storage and dispensing system for a flexible bag comprising a container assembly and a cover. The container assembly having a container storage and dispensing portion, and a container elevating portion. The upstand portion of the container storage and dispensing portion includes a wall defining a spout retaining portion defining an engaging end that is configured to retain a spout of a bag assembly. The spout retaining portion is spaced apart from the upper edge. A spout guiding portion extends from the upper edge to the spout retaining portion. The cover further includes a locking tab having a spout interfacing edge. Attaching the cover to the container assembly directs the locking tab over at least a portion of the spout guiding portion with the spout interfacing edge structurally configured to interface with a portion of the spout of the bag assembly, to retain the same in an engaging orientation.

18 Claims, 14 Drawing Sheets

(56) References Cited

U.S. PATENT DOCUMENTS

| | | | | |
|---|---|---|---|---|
| 6,347,718 | B1 * | 2/2002 | Karpisek | B65D 77/061 206/600 |
| 7,464,567 | B1 * | 12/2008 | Crossley | F25D 3/08 220/345.1 |
| 8,579,161 | B2 * | 11/2013 | Steeb | A21O 5/006 222/146.6 |
| 9,546,086 | B2 * | 1/2017 | Samson | B65D 77/067 |
| 2012/0234864 | A1 * | 9/2012 | Liu | B67D 3/00 222/185.1 |
| 2014/0252040 | A1 * | 9/2014 | Shoup | B67D 3/0083 222/160 |
| 2015/0008242 | A1 * | 1/2015 | Kpabar, Jr. | B67D 3/0061 222/183 |
| 2015/0041495 | A1 * | 2/2015 | Brooks | B65D 75/5877 222/105 |

* cited by examiner

STORAGE AND DISPENSING SYSTEM FOR A FLEXIBLE BAG HAVING A FLOWABLE MATERIAL THEREIN

CROSS-REFERENCE TO RELATED APPLICATION

N/A

BACKGROUND OF THE DISCLOSURE

1. Field of the Disclosure

The disclosure relates in general to flexible packaging, and more particularly, to a storage and dispensing system for a flexible bag having a flowable material therein.

2. Background Art

The use of flexible bags having flowable material is well known in the art. It is well known to have such flexible bags packaged within a rigid outer container, which is often referred to as bag-in-box packaging. While such packaging is known in the art, there is a need for improvement.

For example, such known containers are often not well suited for repeated use of the outer box, and the refilling of the outer box with replacement filled flexible bags, when the flowable material has been dispensed out of a flexible bag. In such instances, most often, the user discards the entire package.

Additionally, for many consumer items, such as laundry detergent and the like, it is known to use a relatively large (i.e., four or five liter) rigid container from which smaller quantities can be dispensed into a separate cup. When the container has been emptied, the user discards the rigid container.

Such containers are large and cumbersome, and have an extremely negative impact on the environment. That is, they are typically not recycled, and typically include a substantial amount of material. There is a constant search for manners in which to improve the reusability and to reduce the disposability of such containers and such dispensing vessels.

SUMMARY OF THE DISCLOSURE

The disclosure is directed to a storage and dispensing system for a flexible bag comprising a container assembly and a cover. The container assembly having a container storage and dispensing portion, and a container elevating portion. The container elevating portion including a plurality of walls defining a lower edge which is configured to be positionable on an outside surface, and an upper end spaced apart therefrom. The container storage and dispensing portion including a base wall and an upstand portion. The base wall has a front end and a back end. At least a portion of the base wall being inclined relative to the lower edge of the container elevating portion. The upstand portion extends upwardly therefrom and terminating at an upper edge and defining a bag assembly cavity. The upstand portion further includes a wall defining a spout retaining portion defining an engaging end that is configured to retain a spout of a bag assembly. The spout retaining portion is spaced apart from the upper edge. A spout guiding portion extends from the upper edge to the spout retaining portion. A portion thereof is wider than a spout positionable within the spout retaining portion. The spout guiding portion and the spout retaining portion meet at opposing transition ridges. The cover is positionable over at least a portion of the bag assembly cavity. The cover further includes a locking tab having a spout interfacing edge. Attaching the cover to the container assembly directs the locking tab over at least a portion of the spout guiding portion with the spout interfacing edge structurally configured to interface with a portion of the spout of the bag assembly, to, in turn, releasably retain the same in an engaging orientation.

In some configurations, the storage and dispensing system further comprises a cup position and retention portion extending from at least one of the container storage and dispensing portion and the container elevating portion. The cup position and retention portion includes a base surface configured to receive a cup thereon in position below a fitment coupled to the spout of the bag assembly.

In some configurations, the base surface extends from the lower edge of the container elevating portion.

In some configurations, the base surface is substantially planar with an outer ridge extending about an outer perimeter of the base surface.

In some configurations, the cup position and retention portion further includes an inset portion defining a outwardly convex surface defined into the container elevating portion below the spout retaining portion. The base surface extending outwardly therefrom.

In some configurations, the inset portion defines a substantially right cylindrical structure.

In some configurations, the container elevating portion and the container storage and dispensing portion each include a front wall, a first side wall and a second side wall. The structures are integrally formed, along with the base wall dividing each of the front wall, first side wall and second side wall between the container elevating portion and the container storage portion.

In some configurations, the container elevating portion defines an opening between the first side wall and the second side wall opposite the front wall, so as to provide access therebetween and below the base wall.

In some configurations, the front wall is substantially perpendicular to the first side wall and the second side wall, which walls are substantially parallel to each other.

In some configurations, the first and second side walls have a length that is greater than a length of the front wall.

In some configurations, the wall having the spout retaining portion comprises a front wall. The base wall includes a front panel portion extending away from the front wall and a rear panel portion extending from the front panel portion and between the first side wall and the second side wall. The front panel portion meets the rear panel portion at a joining edge.

In some configurations, the rear panel portion is oblique to the lower edge of the container elevating portion.

In some configurations, the rear panel portion is oblique to the front panel portion, which is substantially parallel with the lower edge of the container elevating portion.

In some configurations, the opposing transition regions are spaced apart from each other a distance that is less than a width of the spout retaining portion, so that a spout configured for extension into the spout retaining portion is elastically deformed by passage beyond the opposing transition regions.

In some configurations, the spout guiding portion further comprises a first side edge and a second side edge. The first side edge and the second side edge each extend from an upper edge of the upstand portion and the spout retaining portion. The first side edge and the second side edge are oblique to each other and closer to each other proximate the spout retaining portion than the upper edge.

In some configurations, the first side edge and the second side edge are substantially mirror images of each other about a vertical axis bisecting the spout retaining portion.

In some configurations, the top cover further includes a top panel extending the bag assembly cavity. A depending skirt depends therefrom and is structurally configured to overlie a portion of the upstand portion. The locking tab depends from one of the top panel and the depending skirt.

In some configurations, the depending skirt and the locking tab are substantially perpendicular to the top panel.

In some configurations, the locking tab overlies the entirety of the spout guiding portion.

In some configurations, the storage and dispensing system further comprising a bag assembly including a flexible bag, a spout coupled thereto, and a valve coupled to the spout, and in fluid communication with a cavity defined by the flexible bag. The flexible bag is positioned within the bag assembly cavity, with the spout being captured within the spout retaining portion so that the valve is accessible outside of the bag assembly cavity, so as to dispense a flowable material from within the flexible bag in a generally downward direction.

BRIEF DESCRIPTION OF THE DRAWINGS

The disclosure will now be described with reference to the drawings wherein.

DETAILED DESCRIPTION OF THE DISCLOSURE

Figure 1:
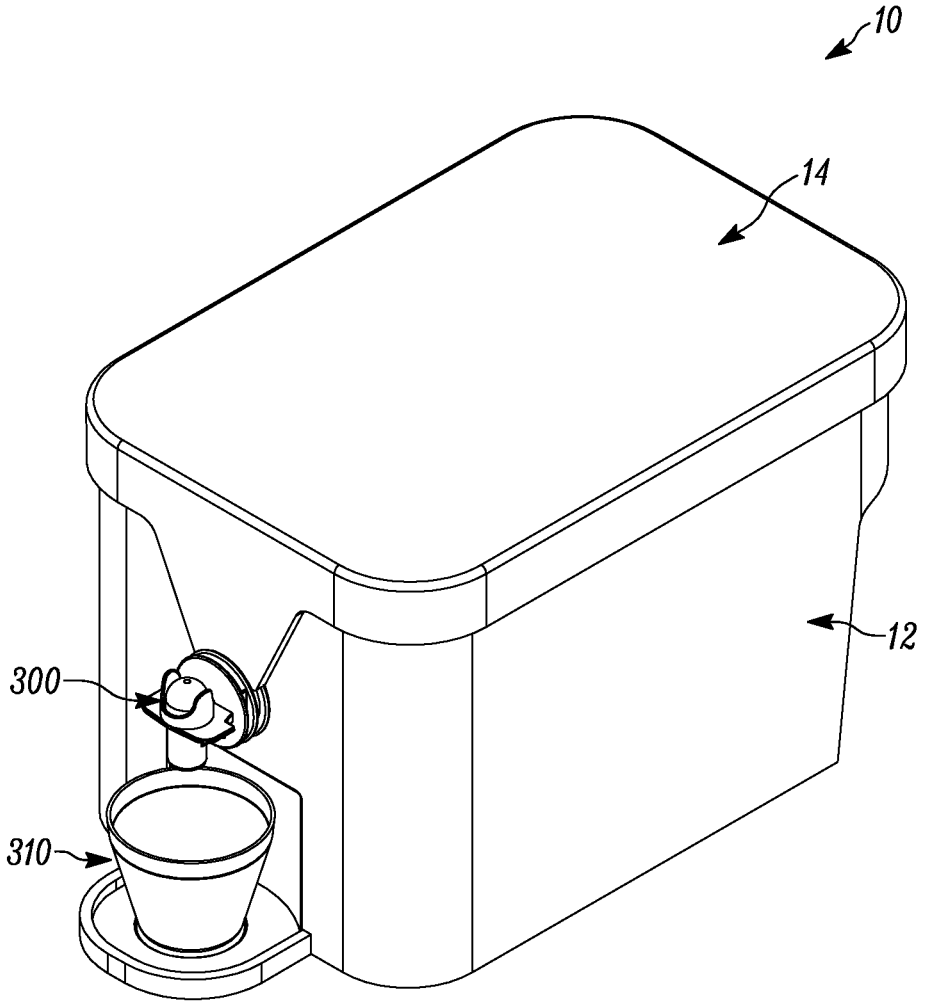
FIG. 1 of the drawings is a perspective view of the storage and dispensing system for a flexible bag assembly of the present disclosure, showing, in particular, the bag assembly and the cup positioned thereon.
Figure 2:
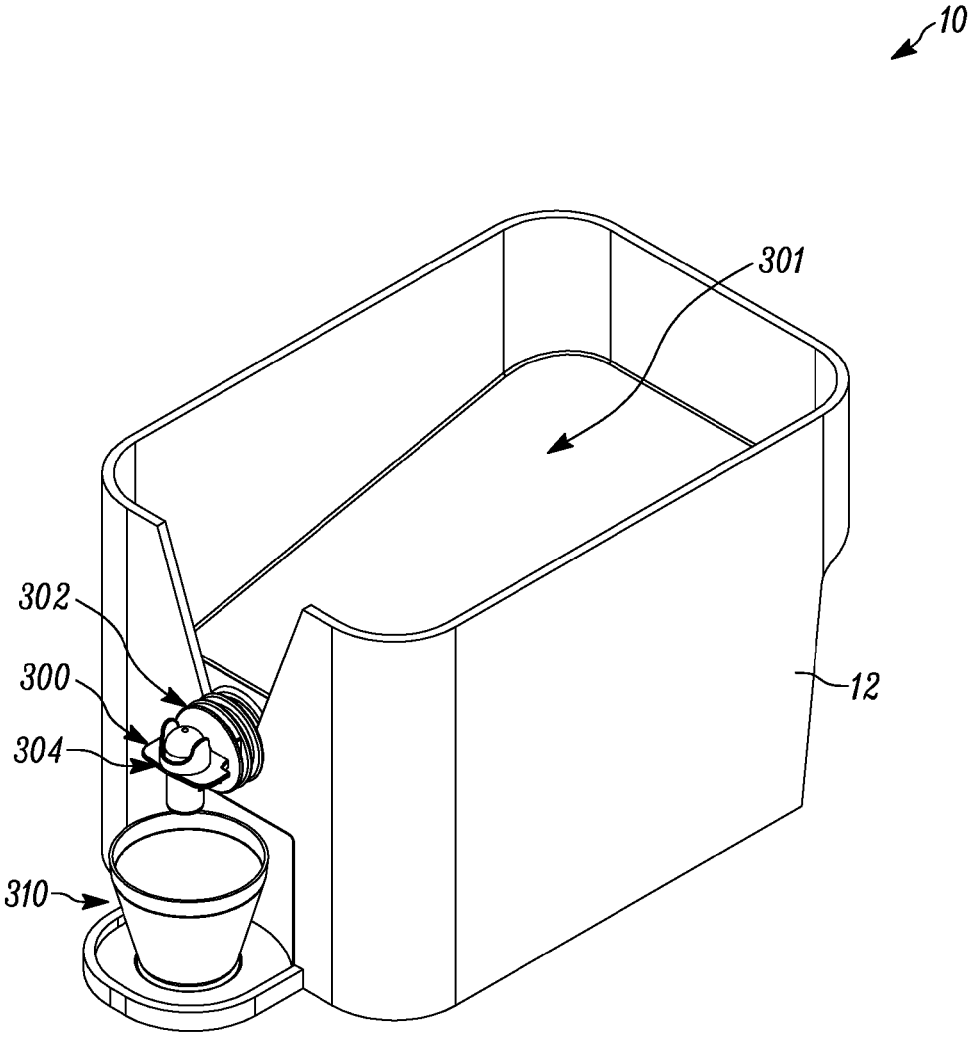
FIG. 2 of the drawings is a perspective view of the storage and dispensing system for a flexible bag assembly of the present disclosure, without the cover member, and with the bag assembly and the cup positioned thereon.
Figure 3:
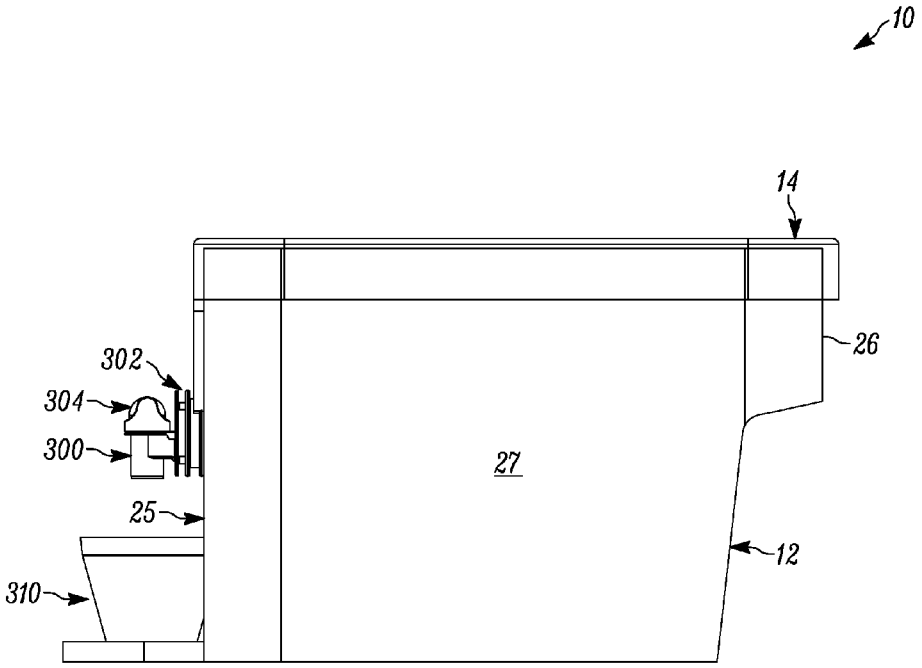
FIG. 3 of the drawings is a first side elevational view of the storage and dispensing system for a flexible bag assembly of the present disclosure, showing, the bag assembly and the cup positioned thereon.
Figure 4:
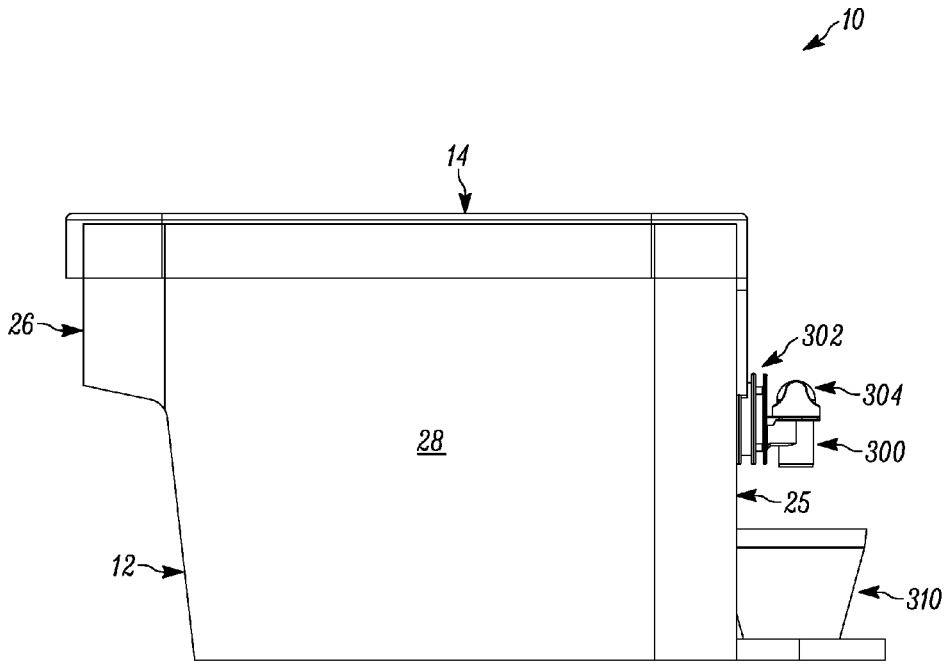
FIG. 4 of the drawings is a second side elevational view of the storage and dispensing system for a flexible bag assembly of the present disclosure, showing, the bag assembly and the cup positioned thereon.
Figure 5:
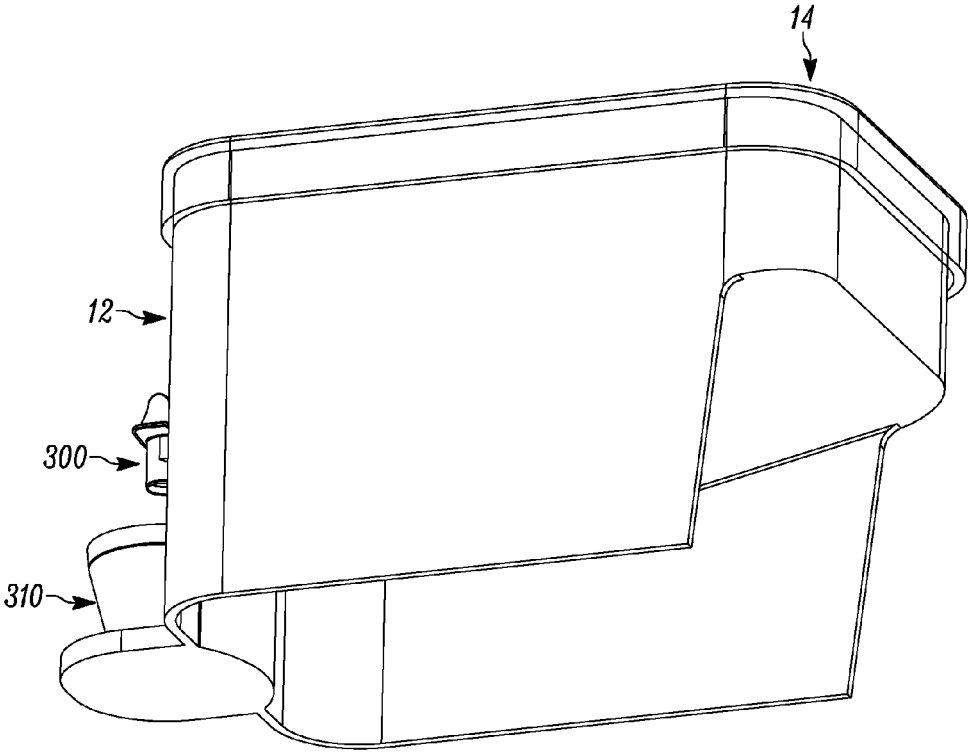
FIG. 5 of the drawings is a bottom perspective view of the storage and dispensing system for a flexible bag assembly of the present disclosure, showing, in particular, the bag assembly and the cup positioned thereon.
Figure 6:
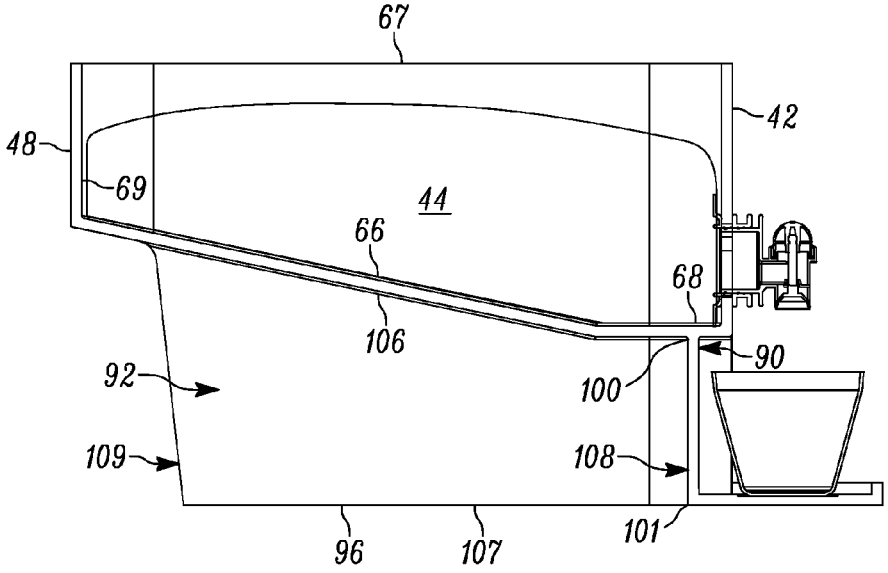
FIG. 6 of the drawings is a first side cross-sectional view of the storage and dispensing system for a flexible bag assembly of the present disclosure, showing, in particular, the bag assembly and the cup positioned thereon.
Figure 7:
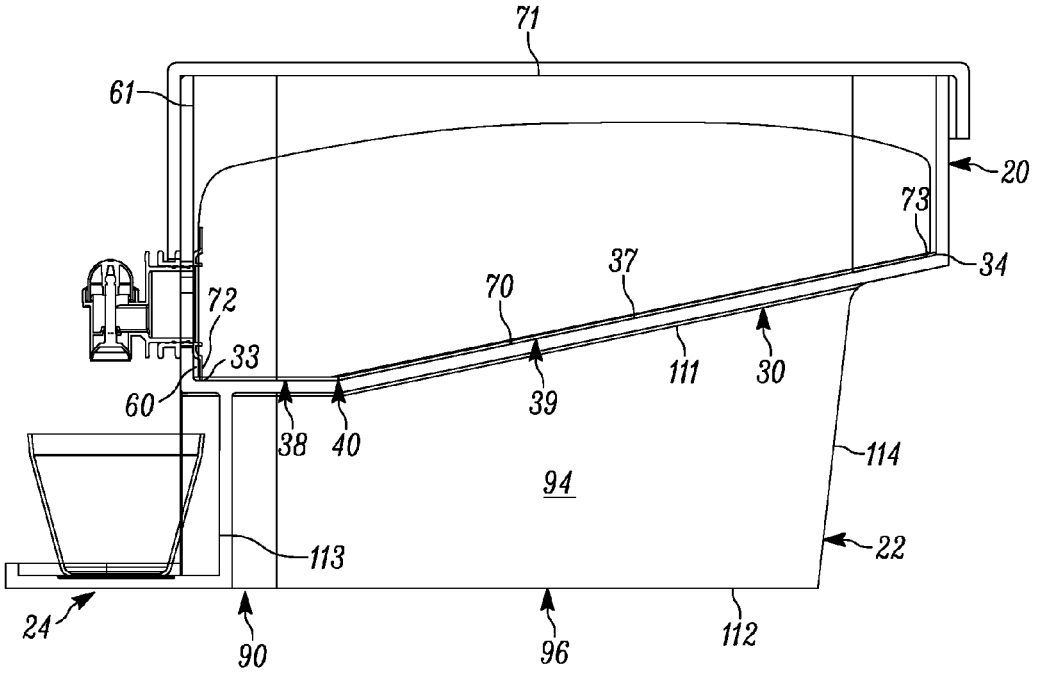
FIG. 7 of the drawings is a second side cross-sectional view of the storage and dispensing system for a flexible bag assembly of the present disclosure, showing, in particular, the bag assembly and the cup positioned thereon.

While this disclosure is susceptible of embodiment in many different forms, there is shown in the drawings and described herein in detail a specific embodiment(s) with the understanding that the present disclosure is to be considered as an exemplification and is not intended to be limited to the embodiment(s) illustrated.

It will be understood that like or analogous elements and/or components, referred to herein, may be identified throughout the drawings by like reference characters. In addition, it will be understood that the drawings are merely schematic representations of the invention, and some of the components may have been distorted from actual scale for purposes of pictorial clarity.

Referring now to the drawings and in particular to FIGS. 1 through 5, the storage and dispensing system for a flexible bag is shown generally at 10. The system can be utilized with any type of flowable material, and, indeed any number of materials are contemplated for use. It is envisioned, although not limited to, use in association with consumer utilized flowable materials, such as detergents, cleaners, fabric softeners and the like. As such, the system can rest or be positioned upon a counter or under a sink in a cabinet, for example. It will be understood that these are merely exemplary and not to be deemed limiting.

The system is disclosed as having container assembly 12 and cover member 14, which are configured to retain a filled bag assembly, such as bag assembly 300 from which the flowable material can be dispensed into cup 310. The bag assembly and the cup will be described in greater detail below, and in particular, in association with the operation of such a system.

The container assembly 12 defines a plurality of separate portions which cooperate to form the same. These portions include the container storage and dispensing portion 20, container elevating portion 22, and cup position and retention portion 24. In the configuration shown, the container assembly is formed from a single integrally molded member. In other configurations, the container assembly may be formed from a plurality of different components that are coupled together through adhesion, molding, heat sealing, interference fits, fasteners, and the like. In the configuration shown, the monolithic integrally molded member is shown. It will further be understood that the integrally molded member may comprise a co-molded configuration that includes multiple different materials.

With further reference to FIGS. 6 through 9, in addition to the previous FIGS. 1 through 5, the container storage and dispensing portion 20 includes base wall 30 and upstand portion 32 which cooperate to form bag assembly cavity 31. The base wall 30 includes front end 33, back end 34, first side edge 36, second side edge 37. The base wall generally comprises a rectangular configuration that is rounded at each corner. The base wall comprises a two portion wall in the configuration shown so that the front end 33 is lower than the back end, and generally the lowest point, so that gravity can be used to direct the flowable material toward the front of the bag (i.e., toward the spout). In the configuration shown, the base wall includes a front panel portion 38 and a back panel portion 39 which meet at joining edge 40.

In the configuration shown, the front panel portion is generally rectangular and substantially shorter than the rear panel portion so that the width dimension of the front panel is bigger than its length, while the rear panel portion has a width dimension that is smaller than its length (as the overall length of the container assembly is greater than its width, in the configuration shown). The front panel portion is substantially planar and generally horizontally disposed. The rear panel portion is oblique to the front panel portion and upwardly angled. In the configuration shown, the rear panel portion is substantially planar. It will be understood that the rear panel portion may be slightly convex and the like, to direct flowable material toward the central region of the base wall, so as to direct the flowable material toward the spout of the bag.

The upstand portion 32 extends upwardly from the base wall 30 and generally surrounds the base wall 30 in a manner that is generally perpendicular to the base wall in some respects and oblique in others (due to the configuration of the rear panel portion of the base wall). The upstand portion includes front wall 42, first side wall 44, second side wall 46 and back wall 48. The walls of the upstand portion define the upper edge 49 at the upper ends thereof, collectively defining an upper opening 47 configured to receive the bag therethrough. Additionally, it will be understood that the walls may be generally planar, and may be curved at the corners 79*a*-79*d* to match the base wall.

Figure 8:
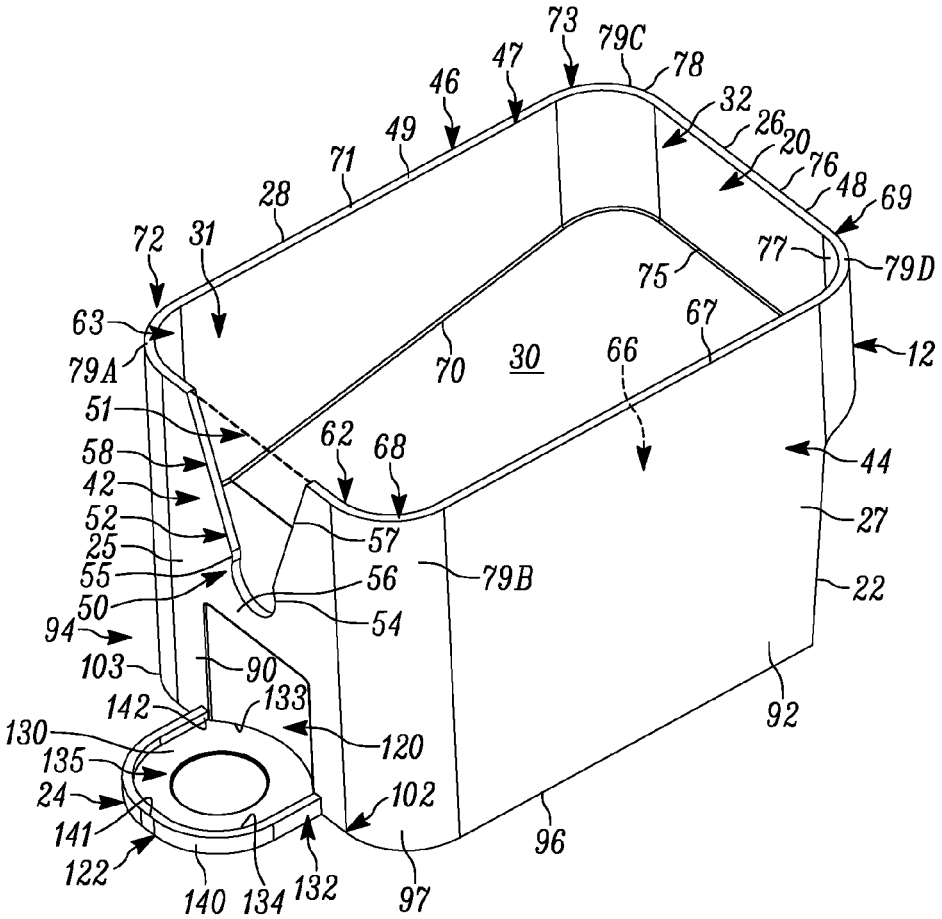
FIG. 8 of the drawings is a perspective view of the container assembly of the storage and dispensing system for a flexible bag assembly of the present disclosure.
Figure 9:
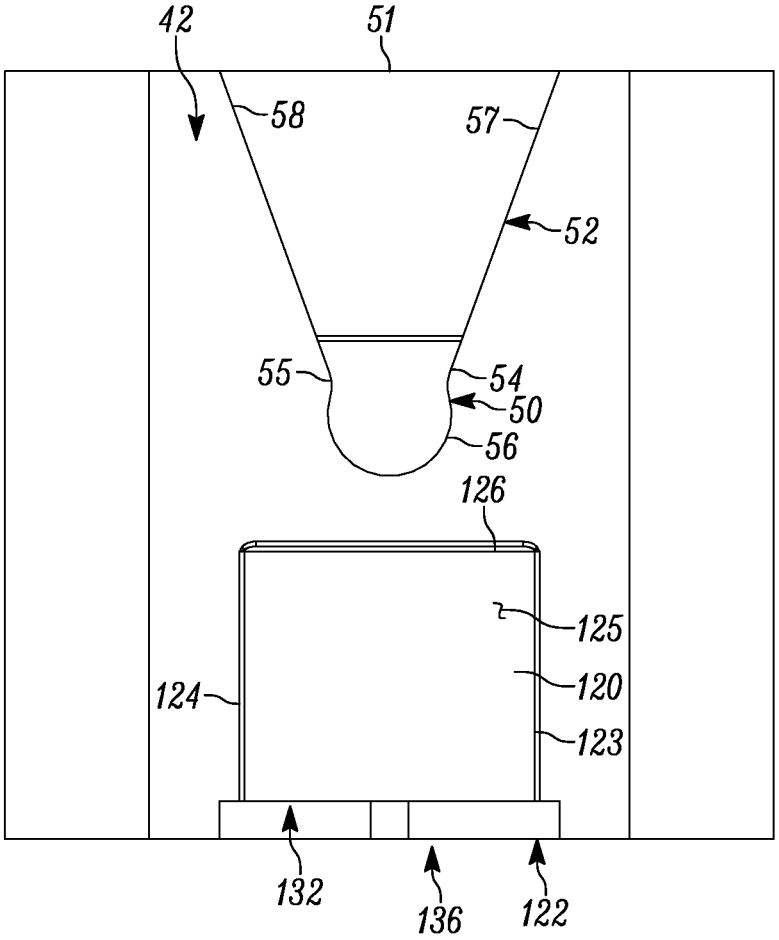
FIG. 9 of the drawings is a front elevational view of the container assembly of the storage and dispensing system for a flexible bag assembly of the present disclosure.
Figure 10:
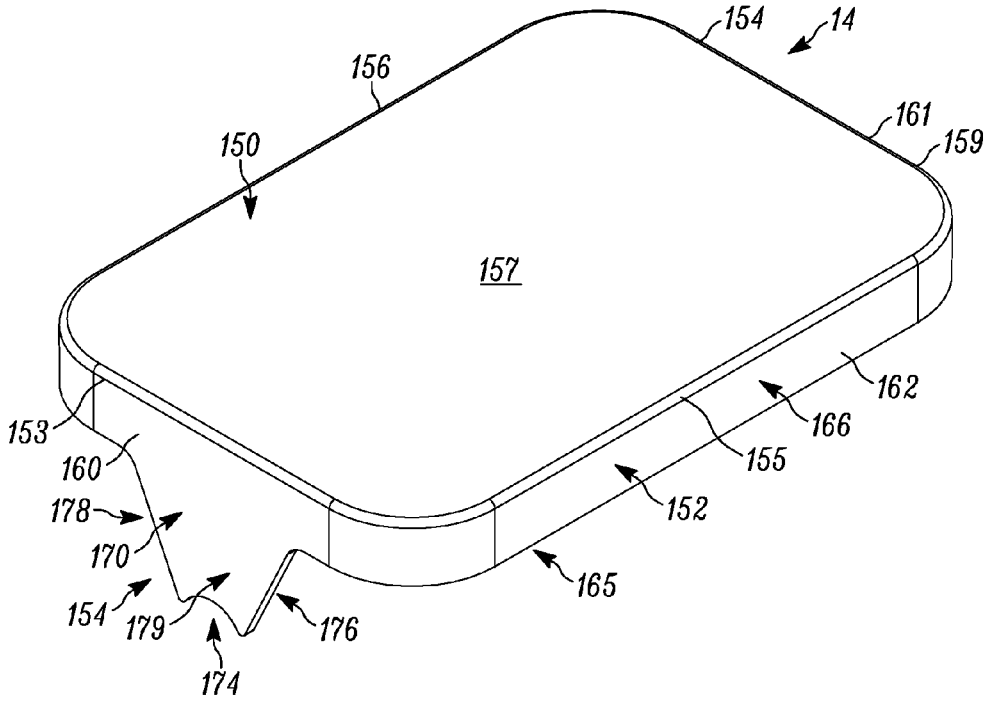
FIG. 10 of the drawings is a top perspective view of the cover member of the storage and dispensing system for a flexible bag assembly of the present disclosure.
Figure 11:
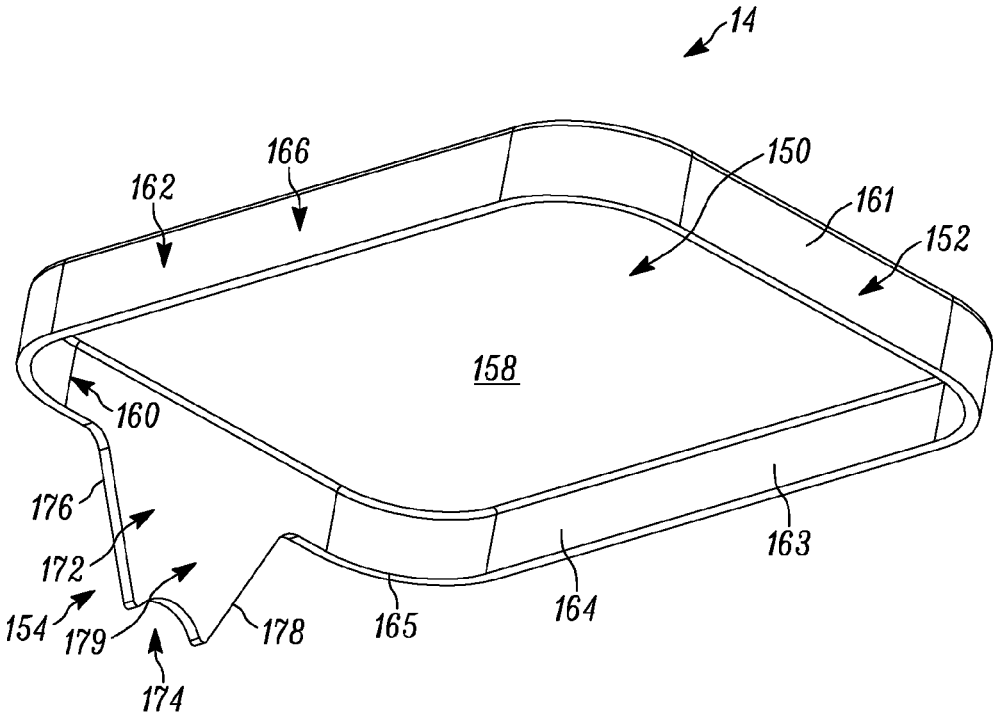
FIG. 11 of the drawings is a bottom perspective view of the cover member of the storage and dispensing system for a flexible bag assembly of the present disclosure.
Figure 12:
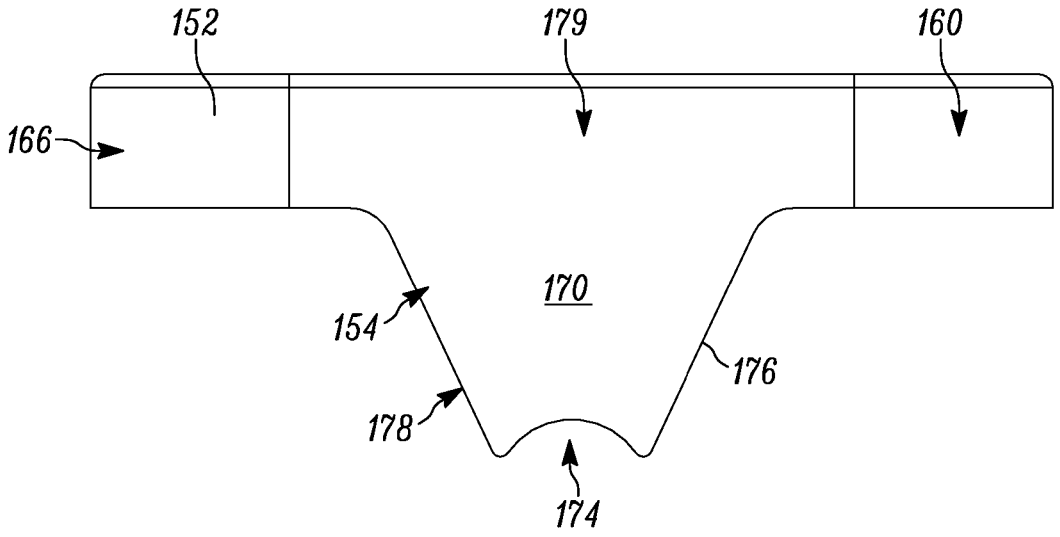
FIG. 12 of the drawings is a front elevational view of the cover member of the storage and dispensing system for a flexible bag assembly of the present disclosure.

The front wall 42 includes lower end 60, upper end 61, first side 62 and second side 63. The lower end meets and extends from the front end 33 of the base wall. With further reference to FIGS. 8 and 9 in particular, the front wall further includes spout retaining portion 50, spout guiding portion 52. The spout retaining portion includes engaging edge 56 which is configured to engage a portion of the spout in releasable engagement. In the configuration shown, more than 180° of releasable engagement is provided by the engaging edge. Extending from either side of the engaging edge, is the spout guiding portion 52, which comprises a first side edge 57 and a second side edge 58. The side edges extend away from each other and away from the engaging edge until intersecting with the upper end 61 of the front wall. The two are displaced at an angle of 15° to 30° relative to a vertical line substantially bisecting the engaging edge. That is, the opening is between 30° and 60° relative to each other. It will be understood that in the configuration shown, the two side edges 57, 58 are centered about the front wall and are mirror images of each other about a vertical line substantially bisecting the engaging edge. In other configurations, the two edges may be other than symmetrical. Depending on the configuration, a greater or smaller angle may be chosen, and, depending on the height, this will result in a larger initial opening 51 at the upper end of the front wall. The spout guiding portion provides a funnel like structure to guide a spout into the proper retained position within the spout retaining portion and to properly engage the engaging edge thereof. As will be understood, the dimensions may be varied depending on the size of the spout and the like.

In the configuration shown, where the spout retaining portion and the spout guiding portion meet, a first transition ridge 54 and second transition ridge 55 can be formed. The ridge extends inwardly wherein the spout guiding portion meets the engaging edge 56. Wherein the engaging edge 56 is greater than 180°, and centered on the vertical line bisecting the engaging edge, the distance between the first and second side edges 57, 58 of the spout guiding portion is less than the diameter of the engaging edge (wherein the engaging edge substantially defines a circular member), and smaller than the diameter of the spout where the spout engages the engaging edge. As such, and as will be explained, the spout is flexed inwardly when passing between the transition ridges 54, 55, and the transition ridges essentially lock the spout in position within the engaging edge. It will be understood that in other configurations, the transition ridges may be integrated with the engaging edge wherein the engaging edge is less than 180° in arcuate length (and centered).

The first side wall 44 includes lower end 66, upper end 67, front end 68 and back end 69. The second side wall 46 includes lower end 70, upper end 71, front end 72 and back end 73. The back wall 48 includes lower end 75, upper end 76, first side 77 and second side 78. As set forth above, the side walls and the front and back wall terminate at the upper end which comprises, in the configuration shown, a generally horizontal upper edge 49, with an opening where the upper edge 49 intersects with the first and second side edge 57, 58 of the spout guiding portion 52. It will be understood that, in the configuration shown, the different walls meet at corners which have been rounded by the curved regions 79*a*-79*d*. In the configuration shown, the thickness of the walls is substantially uniform throughout, with the thickness of the walls substantially matching the spacing between adjacent flanges on the spout between the which the engaging edge extends. It will be understood that in other configurations, modifications can be made to localized thicknesses.

The container elevating portion 22 is shown as comprising front wall 90, first side wall 92 and second side wall 94. Whereas the container storage and dispensing portion is configured to capture and retain the bag assembly, the container elevating portion is configured to elevate the container in such a position wherein a cup or another vessel or structure can be positioned easily below the spout and the valve so as to be filled. Additionally, the container elevating portion 22 further includes a base upon which the bag can be positioned, which maintains stability and provides suitable platform which is generally precluded from tipping over, sliding, or otherwise collapsing in use.

In the configuration shown, the configuration generally matches the upstand portion of the container storage and dispensing portion about the front wall and the first and second side walls. Indeed, the front surface 25 is formed by a cooperation of the front wall 42 and the front wall 90 of the container elevating portion so that the two appear as a continuous wall, and being separated only internally by the base wall 30. To the outside observer, the front wall appears to be a continuous and uninterrupted member. Additionally, the user is unaware of the base wall 30. The same is true with the side walls, although the side walls terminate short of the back wall, and short of the respective curved regions 79*c* and 79*d*. Indeed, in the configuration shown, the first and second side walls include a back edge that is oblique to the vertical, and which then includes an edge that sculpts around the back wall so as to provide an element of design, while providing access to the lower cavity formed by the bottom surface of the base wall, as well as the container elevating portion. It will be understood that the front wall 90, the first side wall 92 and the second side wall 94 together define a lower edge 96 upon which the system 10 is positioned on an outside surface. Generally, this outside surface is preferably substantially horizontal and the like.

With further particular reference to FIGS. 8 and 9, the cup position and retention portion 24 is positioned proximate the front wall of the container elevating portion 22. The cup position and retention portion is configured so as to provide the proper locating and support to a cup, or other structure, that is to be filled from the bag assembly. The portion 24 includes inset portion 120 and cup base portion 122. The inset portion 120 is formed into the front wall 100 (and forms a part of the front wall) of the container elevating portion. The inset portion 120 includes outwardly convex surface 126 that is embedded into the front wall 100 and into the cavity. In the configuration shown, the convex surface 126 comprises a portion of a right cylindrical surface that extends between first edge 123 and second edge 124. The inset portion is defined by the top by upper surface 126 which is corresponds to the lower surface of the base wall 30. The configuration of the convex surface is such that when a cup or other structure is positioned under the valve or fitment, the flowable material can be directed into the cup away from the rim thereof.

The cup base portion 122 includes base surface 130 and outer ridge 132. The base surface 130 comprises inner edge 133, outer edge 134, upper surface 135 and lower surface 136. The inner edge 133 meets the lower end of the convex surface 126 (and, in some configurations, the portions of the lower end 101 of the front wall 90). The outer edge 134 defines a substantially elongated semi-circular configuration that extends outwardly from the front surface. The upper surface 135 spans therebetween and includes cup insert 137 which provides visual cues and or surface variations that allow for the proper placement of the cup or other structure. The lower surface 136 substantially matches the lower edge 96 defined by the container elevating portion.

The outer ridge 132 extends about the outer edge 134 and provides a ridge that precludes sliding of a cup or other structure from the upper surface of the base surface. The outer ridge generally has a rectangular or square cross-sectional configuration with a top surface 141, an inner surface 142 and an outer surface 140. Of course, in other configurations, an outer ridge can be eliminated, or can be formed in another configuration with a different cross-sectional configuration (such as arbitrary, polygonal, triangular, among others).

The cover member 14 is shown in FIGS. 1 through 4 and 10 through 12 as extending over the upper opening 47 and also engaging the spout to further preclude movement of the spout and to maintain the spout in position. The cover member 14 includes top panel 150, depending skirt 152 and locking tab 154. It will be understood that the cover member can be configured to fit over the upper opening and to be secured thereto through a snap fit, interfacing mechanical/releasable engaging members, or merely an interference fit. Additional closure structures such as snaps, locks, straps or the like can be employed to preclude inadvertent removal of the cover member from engagement with the container assembly.

The top panel 150 includes front edge 153, back edge 154, first side edge 155, second side edge 156 which cooperatively define the outer perimeter 159 of the top and bottom surfaces 157, 158. In the configuration shown, the top panel 150 has a substantially uniform thickness and is substantially planar in configuration. In other configurations, variations in topography or thickness are contemplated, as is the inclusion of handles or the like to facilitate removal and handling thereof.

The depending skirt 152 extends around the outer perimeter 159 and depends in a downward direction therefrom. Structurally, the depending skirt matches the upper edge 49 of the upstand portion of the container assembly, so that the depending skirt overlies the outer surface of the upstand portion 32. The depending skirt includes front 160, back 161, first side 162, second side 163, which cooperatively define the inner surface 164, the outer surface 166 and the lower edge 165. It will be understood that the inner surface 164 is configured to overlie and abut the outer surface of the upstand portion 32 of the container assembly in relatively close abutment so as to minimize relative movement (in the horizontal plane) when installed, while allowing for removal and replacement without difficulty (i.e., without being too closely sized to permit alignment and coupling without substantial difficulty).

The locking tab 154 depends from the depending skirt (and/or top panel 150), as an extension, preferably of the front 160 of the depending skirt 152. The locking tab 154 includes outer surface 170, inner surface 172. The surfaces are bounded at the lower end by the spout interfacing edge 174, the first side edge 174 and the second side edge 178, defining a footprint 179. The locking tab 154 defines a footprint that essentially covers the spout guiding portion 52. In the configuration shown, the first and second side edges essentially mirror the relative angles of the first and second edges 57, 58 of the spout guiding portion 52, so as to positioned outboard of the first and second edges 57, 58 and generally parallel thereto. Of course, other configurations are contemplated wherein the locking tab footprint extends over the spout guiding portion without matching the configuration of the spout guiding portion. In still other configurations, the footprint of the locking tab may only cover a part of the spout guiding portion.

The spout interfacing edge 174 is configured to engage the spout between flanges and to generally oppose the spout retaining portion. In the configuration shown, the spout, the spout retaining portion 50 and the spout interfacing edge 174 are substantially centered about a vertical axis substantially bisecting the spout. In other configurations, the spout interfacing edge 174 may be offset or otherwise not symmetrically disposed over the spout. It will be understood that, typically, the spout interfacing edge 174 and the spout retaining portion extend on opposite sides of a flange of the spout, and fall into opposing channels on either side of a flange of the spout. In other configurations, the spout interfacing edge can be offset from the depending skirt or other portions of the locking tab so as to extend into the same slot (i.e., between the same flanges) of the spout. In still other configurations, multiple spout interfacing edges may be presented which interface with multiple slots between flanges on a spout.

Figure 13:
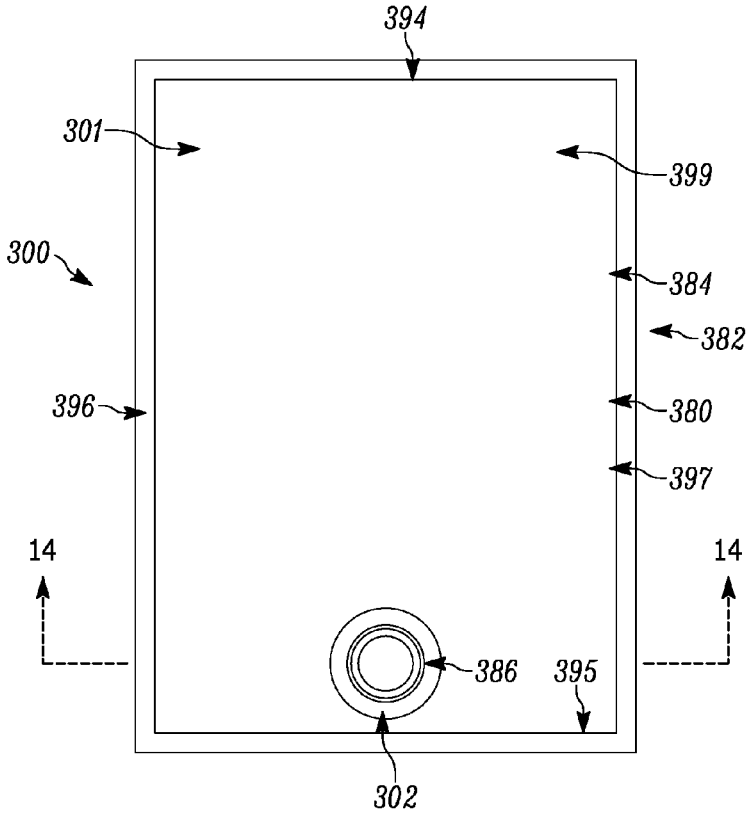
FIG. 13 of the drawings is a top plan view of a flexible bag and spout of the flexible bag assembly that is configured for use in association with the storage and dispensing system for a flexible bag assembly of the present disclosure.
Figure 14:
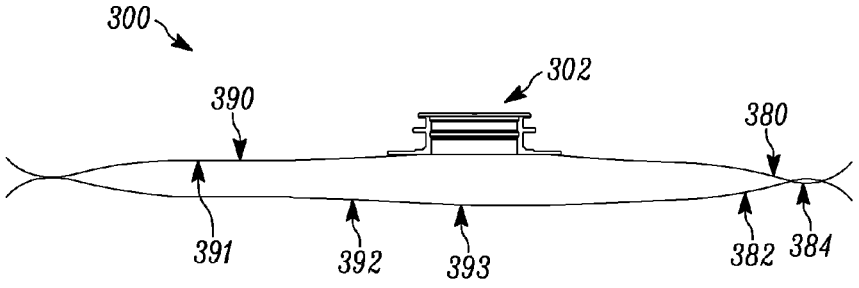
FIG. 14 of the drawings is a cross-sectional view of the flexible bag of FIG. 13 taken about lines 14-14 of FIG. 13.
Figure 15:
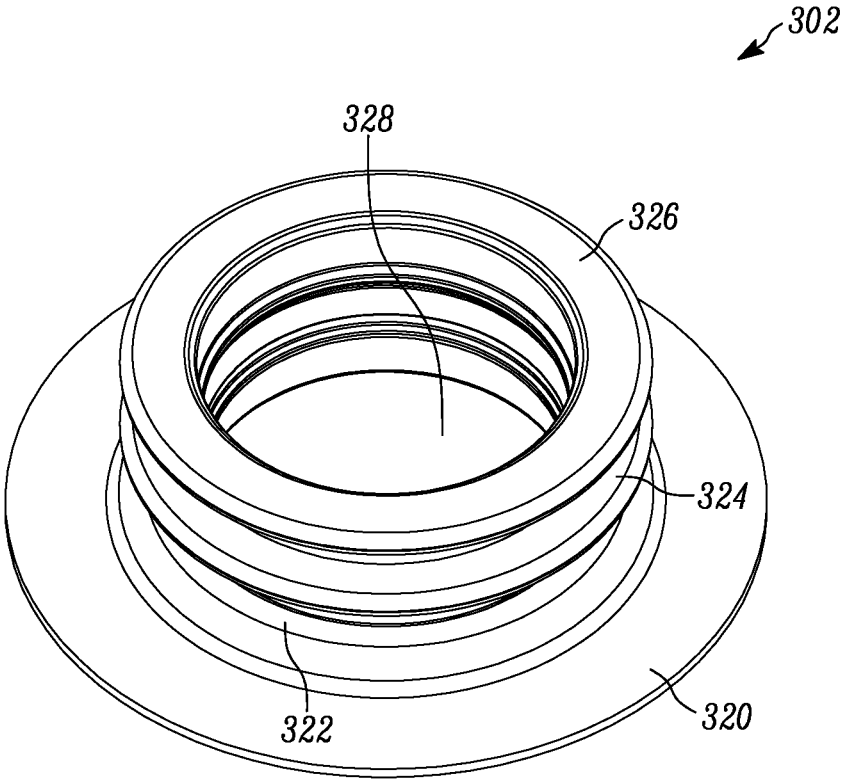
FIG. 15 of the drawings is perspective view of the spout of the flexible bag assembly of FIG. 13.

With reference to FIGS. 1 through 4, the bag assembly 300 includes flexible bag 301, spout 302 and valve/fitment 304. With further reference to FIGS. 13 through 15, flexible bag 301 comprise any number of different configurations and different materials. For example, and not limited thereto, the flexible bag 301 as comprising a pillow type bag formed from a single ply or multiple plies of polymer based film (which may be metallized or otherwise treated). Other types of bags may comprise gusseted bags or the like. The disclosure is not limited to any particular type of bag configuration. Referring again to the pillow type bag shown, such a bag includes front panel 380 and back panel 382. Front panel 380 includes outer surface 390 and inner surface 391. The back panel 382 includes outer surface 392 and inner surface 393. The front and back panel are positioned in an overlying orientation so that the inner surfaces face each other. It will be understood that while a generally rectangular inner bag is shown, a bag of a different shape, such as a shape that mates with the cavity portion of the outer soft box may be utilized.

The panels are then coupled together by way of seals 384. In the case of a pillow type container, the seals 384 include a top seal 394, bottom seal 395, first side seal 396 and second side seal 397. The seals are generally perpendicular to adjacent seals and parallel to opposing seals to generally define a square or rectangular configuration, thereby defining a generally square or rectangular cavity 399. The seals may be formed through the application of heat, or through other procedures, including, but not limited to RF welding, ultrasonic welding, adhesive, among others. The disclosure is not limited to any particular manner of attachment of the panels.

For many pillow type containers, an opening 386 is provided through the front panel 380 proximate, but spaced apart from the bottom seal 395. The spout 302 can be coupled thereto in sealed engagement. In certain embodiments, multiple spouts may be provided, one, for example, for dispensing, and one for filling. The spout 302 includes base flange 320, cylindrical upstand 322, body flanges, such as body flange 324 upper annular rim flange 326 and removable diaphragm 328. The base flange 320 lower surface 334, top surface 333 and outer surface 332. As will be understood to those of skill in the art, the base flange is coupled to the container body (i.e., typically a conventional pillow-type container) through welding, adhesion or other system typically joining the upper surface to the inside of the panels. The cylindrical upstand 322 extends upwardly from the base flange 320, positioned at a proximal end 340 thereof, and extends generally orthogonal thereto toward distal end 341. Typically, the cylindrical upstand is substantially uniform in cross-section and the inner surface defines a passageway with an opening at either end which provides fluid communication with the cavity of the container. An upper opening is positioned at the distal end, and a lower opening is positioned at the proximal end. While termed cylindrical, elliptical as well as other shapes are contemplated.

The body flange 324 includes upper surface 350, lower surface 351 and outer surface 352. The lower body flange is spaced apart from the base flange and is generally parallel thereto. Thus, a generally uniform lower channel 335 is defined between the flanges. Filling equipment and dispensing coupling equipment may be configured to grasp the spout 302 about the geometry defined by the defined lower channel and the associated flanges. In the embodiment shown, the body flange is of a diameter smaller than the base flange. It will be understood that variations are contemplated.

The upper annular rim flange 326 extends about the distal end of the cylindrical upstand 322. In the embodiment shown, the upper annular rim flange 326 includes upper surface 360, lower surface 361 and outer surface 362. The upper annular rim is positioned at or near the distal end 341 of the cylindrical upstand. In the configuration shown, the upper annular rim is positioned at the uppermost end of the cylindrical upstand and defines the distal end of the spout.

The valve/fitment 304 shown in FIGS. 1 through 4 may comprise a number of different structures configured to control the release of flowable material and to dispense the same. The disclosure is not limited to any particular configuration. For example, a cap or a dispensing fitment may be coupled to the above configuration. Such connectors may include those disclosed in WIPO Pub. No. WO2015/142,164 published to Van Der Molen, U.S. Pat. Nos. 4,619,377 and 6,978,981 both of which are issued to Roos as well as U.S. Pat. Nos. 6,045,119; 6,296,157 and 6,360,925 issued to Erb, U.S. Pat. No. 8,336,743 issued to Bellmore, U.S. Pat. No. 7,240,811 issued to Roser, each of which is incorporated herein by reference in their entirety. It is also contemplated that dispensers such as those disclosed in U.S. Pat. No. 7,387,277 issued to Verespej et al, U.S. Pat. No. 7,469,522 issued to Verespej et al, U.S. Pat. No. 7,114,625 issued to Jones, et al, U.S. Pat. No. 8,448,799 issued to Thurman, as well as various Quick connect, disconnect fittings (QCD), among others may be utilized. Additionally, it will be understood that the spout or the cavity may further include different structures to aid in the dispensing of flowable material.

With reference to FIGS. 1 through 4, the cup 301 may comprise a measuring cup or the like, which may include identifications or the like indicating measurements. Of course, other measuring structures, such as pods or the like which may dissolve in the wash, or the like are also contemplated. In still other configurations, a straw or other conduit may be utilized to direct the flowable material straight from the dispenser to a piece of equipment, such as a washing machine or the like.

In operation, in one environment (wherein the disclosure is not limited to such an environment), the system may be utilized in association with a cleaning fluid, such as a laundry detergent. In such a configuration, the user is first provided with the container assembly 12 and cover member 14. In some configurations, the use positions the container assembly on a counter or the like (often proximate a sink or the like). Once positioned, the user is provided with a bag assembly 300. If the cover member is positioned over the cavity 31, the cover member can be removed, to obtain access to the cavity.

Next, the user places the flexible bag 301 into the cavity 31 of the container storage and dispensing portion. As the bag is being placed, the spout 301 is directed into the spout guiding portion 52 through the initial opening 51. In particular, the spout 301 is directed so that the spout guiding portion is secured between the appropriate flanges of the spout (i.e., the base flange and any of the body flanges). In the configuration shown, the spout guiding portion, and the spout retaining portion are grasped between the body flange and the base flange. As the spout funnels through the spout guiding portion, eventually, the spout reaches the transition ridges 54, 55. At that time, the spout can be forced (and elastically deformed, where needed), to pass beyond the transition ridges and to be captured by the spout retaining portion 50 by engaging edge 56 extending between the appropriate flanges.

Once secured in position, the user can insure that the dispensing opening of the valve/fitment 304 is pointed in a downward direction. The user can rotate either the valve/fitment or the spout relative to the container assembly to adjust the position if necessary. It will be understood that the bag assembly is preassembled in a position so that the valve/fitment is properly oriented when inserted into the spout retaining portion.

Next, the user can assemble the top cover, but directing the top cover over the cavity 31 and engaging the same with the depending skirt 152. At such time, the locking tab 154 is directed downwardly and the spout eventually interfaces with the spout interfacing edge 174 of the locking tab. At the same time, it is preferred that the upper edge 49 essentially corresponds to the outer perimeter 159 of the top panel of the cover member. The bag assembly is now in position for dispensing.

To dispense flowable material from the bag assembly, the user places cup 310 on the base surface 130 of the cup position and retention portion 24 of the container assembly 12. In the configuration shown, the cup is placed and guided by the cup inset 137. The user can then dispense from the valve/fitment into the cup.

It will be understood that when all or substantially all of the flowable material has been dispensed from the bag assembly, the bag can be removed from the container assembly and a new full bag can be positioned in the manner described above. As such, the container assembly can be reused, while only the bag assembly is discarded.

It is envisioned that variations are contemplated. In particular, a configuration of the container assembly is envisioned that includes multiple spout retaining portions, each of which can retain a separate spout. In such a configuration, multiple bag assemblies can be placed into the container assembly. In other configurations, it is contemplated that the cup portion 122 may be eliminated so that the user can place the cup on the surface upon which the container assembly is positioned, or suspend the cup in the air while filling. It is further envisioned that the angled disposition of the base wall 30 of the container storage and dispensing portion can be varied depending on the particular flowable material that is utilized, as different fluids may have different flow rates or the like. It is further envisioned that inserts or the like may be utilized on the base wall to adjust the orientation of the bag within the cavity. It is further envisioned, that the bag assembly may include instructions and the like to insure proper positioning within the container storage and dispensing portion.

The foregoing description merely explains and illustrates the disclosure and the disclosure is not limited thereto except insofar as the appended claims are so limited, as those skilled in the art who have the disclosure before them will be able to make modifications without departing from the scope of the disclosure.

What is claimed is:

1. A storage and dispensing system for a flexible bag comprising:

a container assembly having a container storage and dispensing portion, and a container elevating portion, the container elevating portion including a plurality of walls defining a lower edge configured to be positionable on an outside surface, and an upper end spaced apart therefrom;

the container storage and dispensing portion including a base wall and an upstand portion, the base wall having a front end and a back end, with at least a portion of the base wall being inclined relative to the lower edge of the container elevating portion, with the upstand portion extending upwardly therefrom and terminating at an upper edge and defining a bag assembly cavity, the upstand portion further including a wall defining a spout retaining portion defining an engaging end that is configured to retain a spout of a bag assembly, the spout retaining portion spaced apart from the upper edge, with a spout guiding portion extending from the upper edge to the spout retaining portion, a portion thereof being wider than a spout positionable within the spout retaining portion, the spout guiding portion and the spout retaining portion meeting at opposing transition ridges; and a cover positionable over at least a portion of the bag assembly cavity, the cover further including a locking tab having a spout interfacing edge, whereupon attaching the cover to the container assembly directs the locking tab over at least a portion of the spout guiding portion with the spout interfacing edge structurally configured to interface with a portion of the spout of the bag assembly, to, in turn, releasably retain the same in an engaging orientation;

wherein the container elevating portion and the container storage and dispensing portion each include a front wall, a first side wall and a second side wall, wherein the structures are integrally formed, along with the base wall dividing each of the front wall, first side wall and second side wall between the container elevating portion and the container storage portion;

wherein the container elevating portion defines an opening between the first side wall and the second side wall opposite the front wall, so as to provide access therebetween and below the base wall.

2. The storage and dispensing system of claim 1 further comprising a cup position and retention portion extending from at least one of the container storage and dispensing portion and the container elevating portion, the cup position and retention portion including a base surface configured to receive a cup thereon in position below a fitment coupled to the spout of the bag assembly.

3. The storage and dispensing system of claim 2 wherein the base surface extends from the lower edge of the container elevating portion.

4. The storage and dispensing system of claim 3 wherein the base surface is substantially planar with an outer ridge extending about an outer perimeter of the base surface.

5. The storage and dispensing system of claim 2 wherein the cup position and retention portion further includes an inset portion defining a outwardly convex surface defined into the container elevating portion below the spout retaining portion, with the base surface extending outwardly therefrom.

6. The storage and dispensing system of claim 5 wherein the inset portion defines a substantially right cylindrical structure.

7. The storage and dispensing system of claim 1 wherein the front wall is substantially perpendicular to the first side wall and the second side wall, which walls are substantially parallel to each other.

8. The storage and dispensing system of claim 1 wherein the first and second side walls have a length that is greater than a length of the front wall.

9. The storage and dispensing system of claim 1 wherein the wall having the spout retaining portion comprises a front wall, the base wall includes a front panel portion extending away from the front wall and a rear panel portion extending from the front panel portion and between the first side wall and the second side wall, the front panel portion meeting the rear panel portion at a joining edge.

10. The storage and dispensing system of claim 9 wherein the rear panel portion is oblique to the lower edge of the container elevating portion.

11. The storage and dispensing system of claim 10 wherein the rear panel portion is oblique to the front panel portion, which is substantially parallel with the lower edge of the container elevating portion.

12. The storage and dispensing system of claim 1 wherein the opposing transition ridges are spaced apart from each other a distance that is less than a width of the spout retaining portion, so that a spout configured for extension into the spout retaining portion is elastically deformed by passage beyond the opposing transition ridges.

13. The storage and dispensing system of claim 1 wherein the spout guiding portion further comprises a first side edge and a second side edge, the first side edge and the second side edge each extending from an upper edge of the upstand portion and the spout retaining portion, wherein the first side edge and the second side edge are oblique to each other and closer to each other proximate the spout retaining portion than the upper edge.

14. The storage and dispensing system of claim 13 wherein the first side edge and the second side edge are substantially mirror images of each other about a vertical axis bisecting the spout retaining portion.

15. The storage and dispensing system of claim 1 wherein the top cover further includes a top panel extending the bag assembly cavity, with a depending skirt depending therefrom structurally configured to overlie a portion of the upstand portion, wherein the locking tab depends from one of the top panel and the depending skirt.

16. The storage and dispensing system of claim 15 wherein the depending skirt and the locking tab are substantially perpendicular to the top panel.

17. The storage and dispensing system of claim 16 wherein the locking tab overlies the entirety of the spout guiding portion.

18. The storage and dispensing system of claim 1 further comprising a bag assembly including a flexible bag, a spout coupled thereto, and a valve coupled to the spout, and in fluid communication with a cavity defined by the flexible bag, the flexible bag being positioned within the bag assembly cavity, with the spout being captured within the spout retaining portion so that the valve is accessible outside of the bag assembly cavity, so as to dispense a flowable material from within the flexible bag in a generally downward direction.

* * * * *